US012753989B2

(12) United States Patent
Çakir

(10) Patent No.: US 12,753,989 B2
(45) Date of Patent: Oct. 6, 2026

(54) HANDGRIP ASSEMBLY

(71) Applicant: Said Yusuf Çakir, Eyupsultan Istanbul (TR)

(72) Inventor: Said Yusuf Çakir, Eyupsultan Istanbul (TR)

( * ) Notice: Subject to any disclaimer, the term of this patent is extended or adjusted under 35 U.S.C. 154(b) by 0 days.

(21) Appl. No.: 18/881,459

(22) PCT Filed: Nov. 23, 2023

(86) PCT No.: PCT/TR2023/051387
§ 371 (c)(1),
(2) Date: Jan. 6, 2025

(87) PCT Pub. No.: WO2024/191379
PCT Pub. Date: Sep. 19, 2024

(65) Prior Publication Data

US 2026/0009616 A1 Jan. 8, 2026

(30) Foreign Application Priority Data

Mar. 16, 2023 (TR) ..... TR2023002951

(51) Int. Cl.
*F41C 23/10* (2006.01)
*F41C 23/14* (2006.01)

(52) U.S. Cl.
CPC ..... *F41C 23/10* (2013.01); *F41C 23/14* (2013.01)

(58) Field of Classification Search
CPC ..... F41C 23/10; F41C 23/14
See application file for complete search history.

(56) References Cited

U.S. PATENT DOCUMENTS 4,286,401 A * 9/1981 Pachmayr ..... F41C 23/10 42/71.02
4,586,282 A * 5/1986 Sniezak ..... F41C 23/10 42/71.02
5,231,237 A * 7/1993 Cupp ..... F41C 23/10 42/71.02
D344,124 S * 2/1994 Cupp ..... F41C 23/10 D22/104
6,112,446 A * 9/2000 Forster ..... F41C 23/10 42/74
6,269,576 B1 * 8/2001 Williams ..... F41A 17/74 42/70.11
7,748,153 B2 * 7/2010 Beretta ..... F41C 23/10 42/71.02

(Continued)

OTHER PUBLICATIONS

International Search Report, Turkish Patent and Trademark Office, Feb. 29, 2024.

(Continued)

*Primary Examiner* — Michelle Clement
(74) *Attorney, Agent, or Firm* — Bay State IP, LLC

(57) ABSTRACT

The present invention, a handgrip assembly, generally relates to firearms that have a handgrip and a backstrap thereon. The present invention comprises an interlocking backstrap, which replaces the prior art backstrap of a handgrip; and a fully enveloping grip sleeve, which enables form and texture modifications on all sides of the handgrip of the firearm. The present invention can be restrained on the frame of the gun across all degrees of freedom without the use of screws or extraneous fasteners.

7 Claims, 8 Drawing Sheets

(56) References Cited

U.S. PATENT DOCUMENTS

| | | | | |
|---|---|---|---|---|
| 7,805,876 | B1 * | 10/2010 | Danielson | F41G 11/004 42/117 |
| 8,186,089 | B2 * | 5/2012 | Werner | F41C 23/10 42/71.02 |
| 8,438,772 | B2 * | 5/2013 | Andreis | F41C 23/02 42/72 |
| 8,615,918 | B2 * | 12/2013 | Shepard, Jr. | F41C 23/10 362/110 |
| 8,720,098 | B2 * | 5/2014 | Burress, Jr. | F41C 23/10 42/71.01 |
| 8,857,093 | B2 * | 10/2014 | Hogue | F41C 23/10 42/74 |
| 8,950,098 | B2 * | 2/2015 | Sims | F41C 23/08 42/1.06 |
| D726,861 | S * | 4/2015 | Siddle | F41C 23/10 D22/108 |
| 9,322,610 | B2 * | 4/2016 | Zajk | F41C 23/10 |
| 9,752,849 | B2 * | 9/2017 | Anderson | F41C 23/08 |
| 9,777,983 | B2 * | 10/2017 | Porat | F41G 11/003 |
| 9,851,174 | B1 * | 12/2017 | Bailey | F41C 3/00 |
| 9,909,830 | B1 * | 3/2018 | Toole | F41G 1/35 |
| 10,054,392 | B2 * | 8/2018 | Maroney | F41C 23/10 |
| 10,101,115 | B1 * | 10/2018 | Bailey | F41C 23/10 |
| 10,180,301 | B2 * | 1/2019 | Hogue | F41C 23/10 |
| 10,731,936 | B1 * | 8/2020 | Sapio | F41A 11/00 |
| 10,809,037 | B2 * | 10/2020 | Bruhns | F41C 23/10 |
| 10,921,076 | B1 * | 2/2021 | Thomas | F41A 9/82 |
| 10,962,313 | B2 * | 3/2021 | Noonan | F41C 23/20 |
| 11,015,898 | B2 * | 5/2021 | Porat | F41G 11/003 |
| 11,022,388 | B1 * | 6/2021 | Noonan | F41A 19/14 |
| 11,073,351 | B2 * | 7/2021 | Tai | F41A 9/61 |
| 11,079,189 | B2 * | 8/2021 | Hsu | F41A 3/66 |
| 11,454,469 | B2 * | 9/2022 | Nilson | F41A 11/02 |
| 11,466,954 | B2 * | 10/2022 | Hughes | F41C 23/10 |
| 11,578,935 | B2 * | 2/2023 | Hsu | F41A 3/66 |
| 11,774,212 | B2 * | 10/2023 | Noonan | F41C 23/10 42/71.02 |
| 12,078,439 | B2 * | 9/2024 | Curry | F41A 19/44 |
| 12,320,606 | B2 * | 6/2025 | Strechinski | F41C 23/10 |
| 12,474,131 | B2 * | 11/2025 | Hell | F41A 3/66 |
| 2008/0060247 | A1 * | 3/2008 | Thomele | F41A 3/66 42/71.02 |
| 2010/0212202 | A1 | 8/2010 | Roth | |
| 2011/0167698 | A1 | 7/2011 | Hoguc | |
| 2017/0184364 | A1 * | 6/2017 | Dewitt | F41C 23/10 |
| 2020/0408485 | A1 * | 12/2020 | Bruhns | F41C 23/22 |
| 2021/0172702 | A1 * | 6/2021 | Harrigan | F41C 3/00 |
| 2024/0200899 | A1 * | 6/2024 | Noonan | F41C 23/10 |
| 2025/0164205 | A1 * | 5/2025 | Aral | F41C 23/10 |
| 2025/0189266 | A1 * | 6/2025 | Magnus | F41A 3/66 |
| 2025/0314451 | A1 * | 10/2025 | Underwood | F41C 23/14 |
| 2025/0327639 | A1 * | 10/2025 | Underwood | F41C 23/14 |

OTHER PUBLICATIONS

Written Opinion ISA, Turkish and Patent Trademark Office, Feb. 29, 2024.

* cited by examiner

HANDGRIP ASSEMBLY

CROSS REFERENCE TO RELATED APPLICATION

This application is for entry into the U.S. National Phase from which priority is claimed under all applicable sections of Title 35 of the United States Code including, but not limited to, Sections 120, 363, and 365 (c) to International Application No. PCT/TR2023/051387 filed on Nov. 23, 2023, and which in turn claims priority under 35 USC 119 to Turkish Patent Application No. TR2023002951 filed on Mar. 16, 2023, the contents of which are incorporated by reference herein in its entirety as part of the present application.

FIELD OT THE INVENTION

The present invention, a handgrip assembly, generally relates to firearms that have a handgrip and a backstrap thereon.

BACKGROUND OF THE INVENTION

Firearm manufacturers aim to provide grip customization through the use of various sizes and shapes of backstraps so that an optimal interface is achieved between a user's hands and the handgrip. Such backstrap modifications change the lateral distance between the front strap and the backstrap.

Prior art firearm grips with backstraps suffer from the following shortcomings: Prior art solutions with backstraps generally cannot exceed the thickness of the firearm's frame and are unable to fill the sides of the grip.

Since most prior art backstraps are not able to affect the shape of the sides of a handgrip, form and texture modifications on the regions corresponding to a user's palms cannot be made. Lateral form and texture adjustments on a handgrip are crucial factors in facilitating an ergonomic grip.

Even though some prior art backstrap variations extending out to the sides of the grip do exist, the fact that these solutions cannot envelop the grip on all sides poses a great limitation.

To attain additional friction and fit, many gun owners, especially those participating in competitive shooting matches, are known to treat their gun frames with irreversible modifications (e.g., stippling, epoxy putty/silicon carbide). The risk of irreparable damage notwithstanding, these applications greatly reduce or completely eliminate the resale value of a firearm.

Prior art backstraps are not structured to accommodate a magwell; a feature designed to improve proper magazine placement during reloading of a firearm; as such, their function cannot extend to performance and consistency improvements in reloading of a firearm.

SUMMARY OF THE INVENTION

The present invention eliminates the above problems.

The present invention comprises an interlocking backstrap, which replaces the prior art backstrap of a handgrip; and a fully enveloping grip sleeve, which enables form and texture modifications on all sides of the handgrip of the firearm. The present invention can be restrained on the frame of the gun across all degrees of freedom without the use of screws or extraneous fasteners.

The present invention extends the ergonomic influence of prior art backstraps to the sides of the handgrip; the present invention also covers the frontstrap region, facilitating 360-degrees of freedom when administering form and texture modifications all around the handgrip.

The present invention does not make permanent changes to the firearm. Treatments such as stippling, silicon carbide coating, or any other novel treatment intended for handgrips can be applied to the invention, which is removable and replaceable; the modifications, therefore, remain reversible.

The present invention, as it will be understood by those of skill in the art, is applicable to a wide variety of firearms without departing from the scope of the invention or the method.

In one embodiment of the invention, the assembly includes a magwell: a funnel-shaped geometric feature, usually an add-on, that guides the magazine body into the magazine cavity to help speed up and increase the consistency of the process of reloading.

PARTS AND COMPONENTS

1. Firearm
1.1 Handgrip
1.1.1 Shaded Area-2
1.1.2 Frontstrap
1.2 Prior Art Backstrap
1.2.1 Shaded Area-1
1.2.2 Top Side of Prior Art Backstrap
1.2.3 Prior Art Backstrap Top Protrusion
1.3 Grip Assembly
1.3.1 Grip Sleeve
1.3.1.1 Sleeve Protrusion
1.3.1.2 Magwell
1.3.1.3 Magwell Protrusion
1.3.2 Interlocking Backstrap
1.3.2.1 Sleeve Cavity
1.3.2.2 Backstrap Top Protrusion
1.3.2.3 Chamfered Regions
1.3.2.4 Magwell Cavity
1.4 Locking Pin
10. y-direction
11. x-direction
12. i-direction
13. z-direction
14. Initial position for installation
15. w-direction

DETAILED DESCRIPTION OF THE PREFERRED EMBODIMENTS

There is a large variety in the geometry of backstraps implemented in the firearms industry. For the sake of practicality, it is not intended to depict individual adaptations of the invention's components to multiple prior art variations. As such, the representation of the prior art is drawn to loosely resemble a specific model, namely a CANIK TP9 as the preferred embodiment. It will be understood by those of skill in the art that the invention is applicable to a wide variety of firearms without departing from the scope of the invention or the method.

Figure 1:
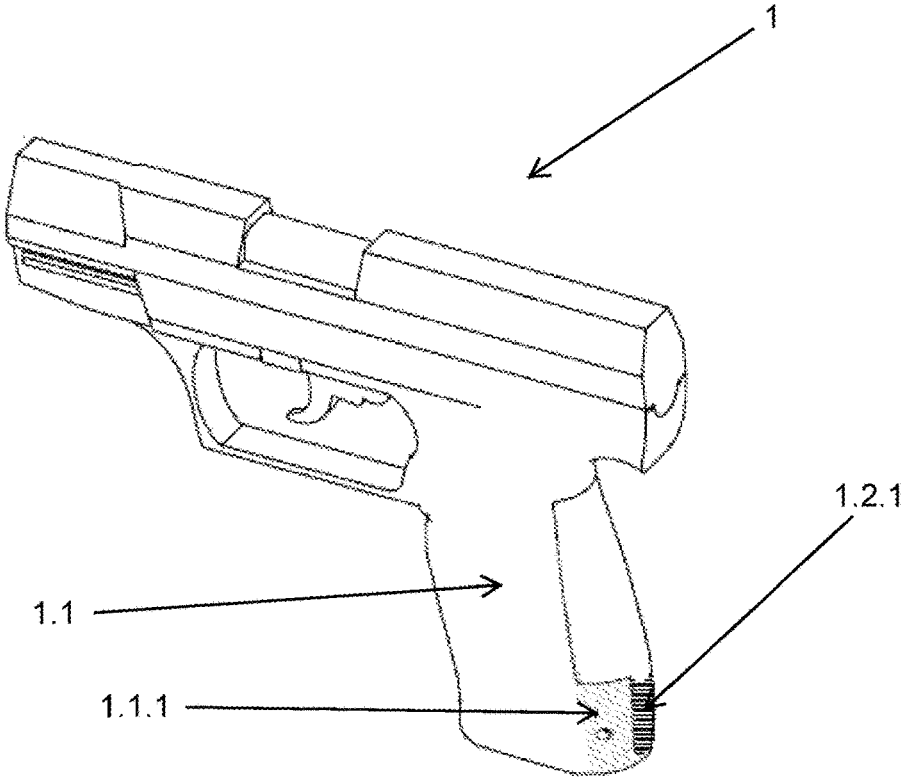
FIG. 1 is a perspective view of a firearm with the prior art backstrap attached to the handgrip of a firearm.

As depicted in FIG. 1 and according to the present embodiment, the prior art backstrap (1.2) aims to form a better interface between a user's hands and the handgrip (1.1) of a firearm (1) via replaceable backstrap (1.2) options that change the lateral distance between the front strap and the backstrap surface. Such an approach cannot provide means for customization, neither on the sides nor on the front strap side of a handgrip (1.1). Considering the complex shape of a hand, this kind of one-sided approach to handgrip (1.1) customization is a major shortcoming. It is known, particularly in shooting sports, that better-conforming grip geometries, especially ones addressing low-pressure regions on the sides of the handgrip (1.1) corresponding to the palm portion of the hand, facilitate greater control on the firearm.

As depicted in FIG. 1, shaded area-1 (1.2.1) on the prior art backstrap (1.2) and shaded area-2 (1.1.1) on the handgrip (1.1) have to conform to one another and form a smooth surface when meshed together so as to avoid having bulging or overhanging regions around the boundaries. Shaded area-2 (1.1.1), being a factory feature of the handgrip (1.1), cannot be modified reversibly. Despite shaded area-1 (1.2.1) and shaded area-2 (1.1.1) being located at a crucial position for the ergonomics of a firearm, the inability to modify this region constitutes a considerable shortcoming for the prior art.

Figure 2:
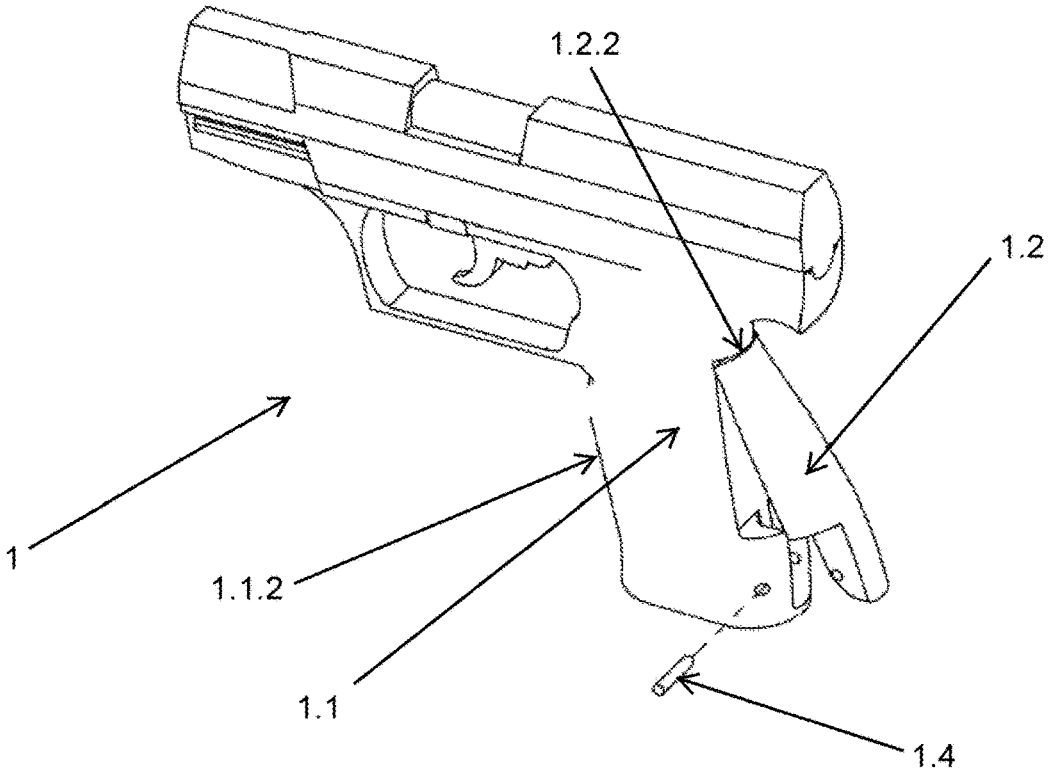
FIG. 2 is a perspective view of prior art backstrap locking pin in exploded configuration with the prior art backstrap partially removed.

Prior art backstraps cannot make changes to the frontstrap (1.1.2) region depicted in FIG. 2. With prior art backstraps, finger grooves, if not already built into the grip, cannot be implemented on the frontstrap (1.1.2), should a user prefer to have them.

Figure 3:
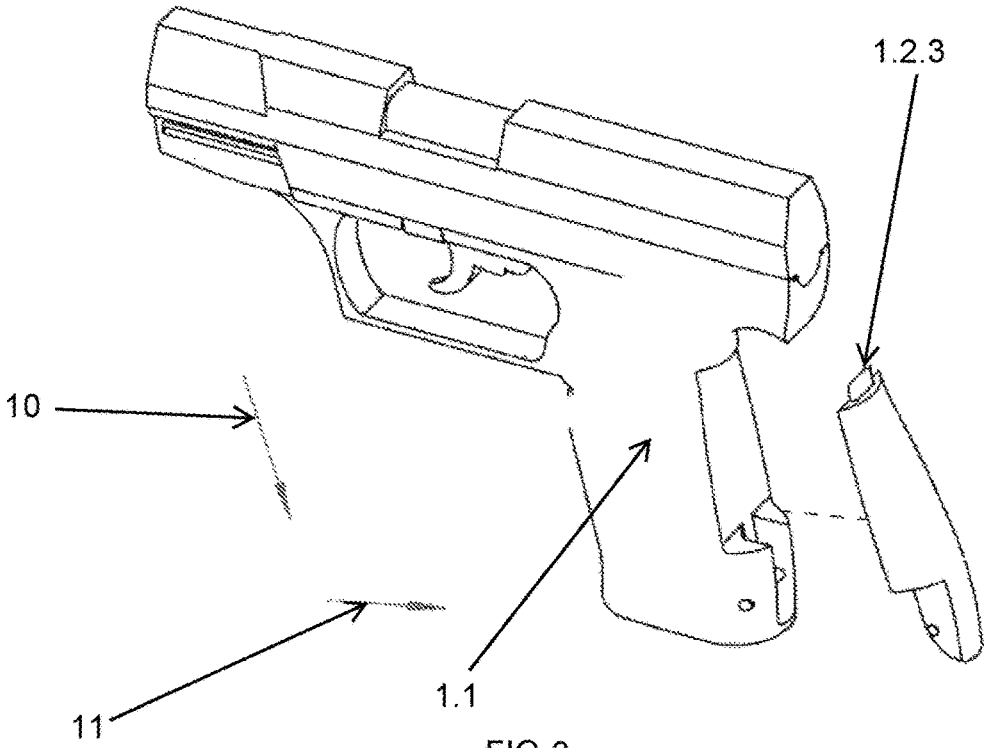
FIG. 3 is a perspective view of prior art backstrap in exploded configuration.

The process of removal of prior art backstrap (1.2) is achieved by first hammering out the locking pin (1.4) via a rod of appropriate diameter. This frees the lower portion of the prior art backstrap (1.2), which can then, with the help of a tool such as a screwdriver in shaded area-1 (1.2.1), be rotated about the top side of the prior art backstrap (1.2.2) as depicted in FIG. 2. Consequently, the prior art backstrap (1.2) is moved in y-direction (10) as in FIG. 3 to pull the prior art backstrap top protrusion (1.2.3) out of its corresponding cavity in a firearm's frame. The prior art backstrap (1.2) is then moved in the x-direction (11) to finalize the process of removal.

Figure 4:
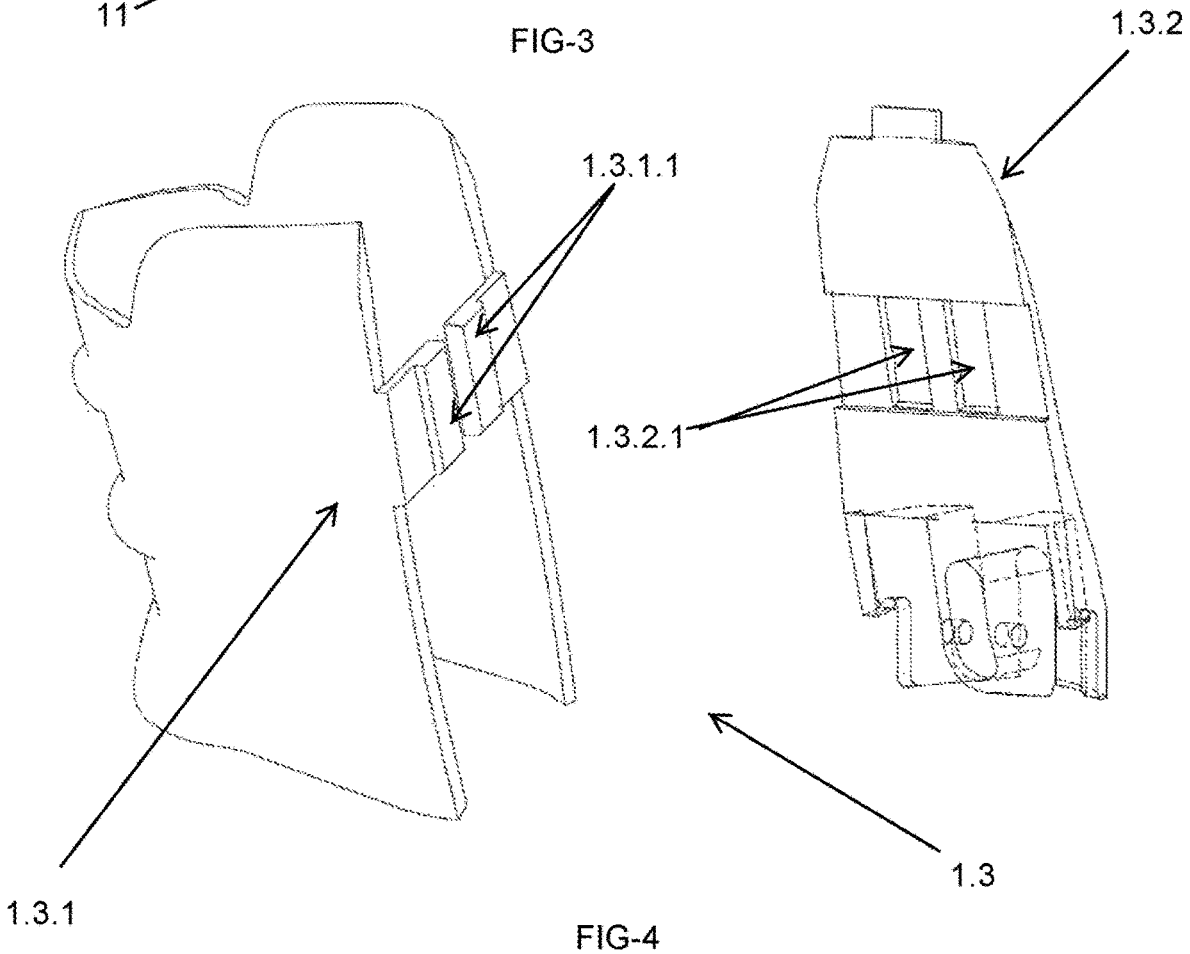
FIG. 4 is a perspective view of the present invention's components in disassembled configuration.
Figure 5:
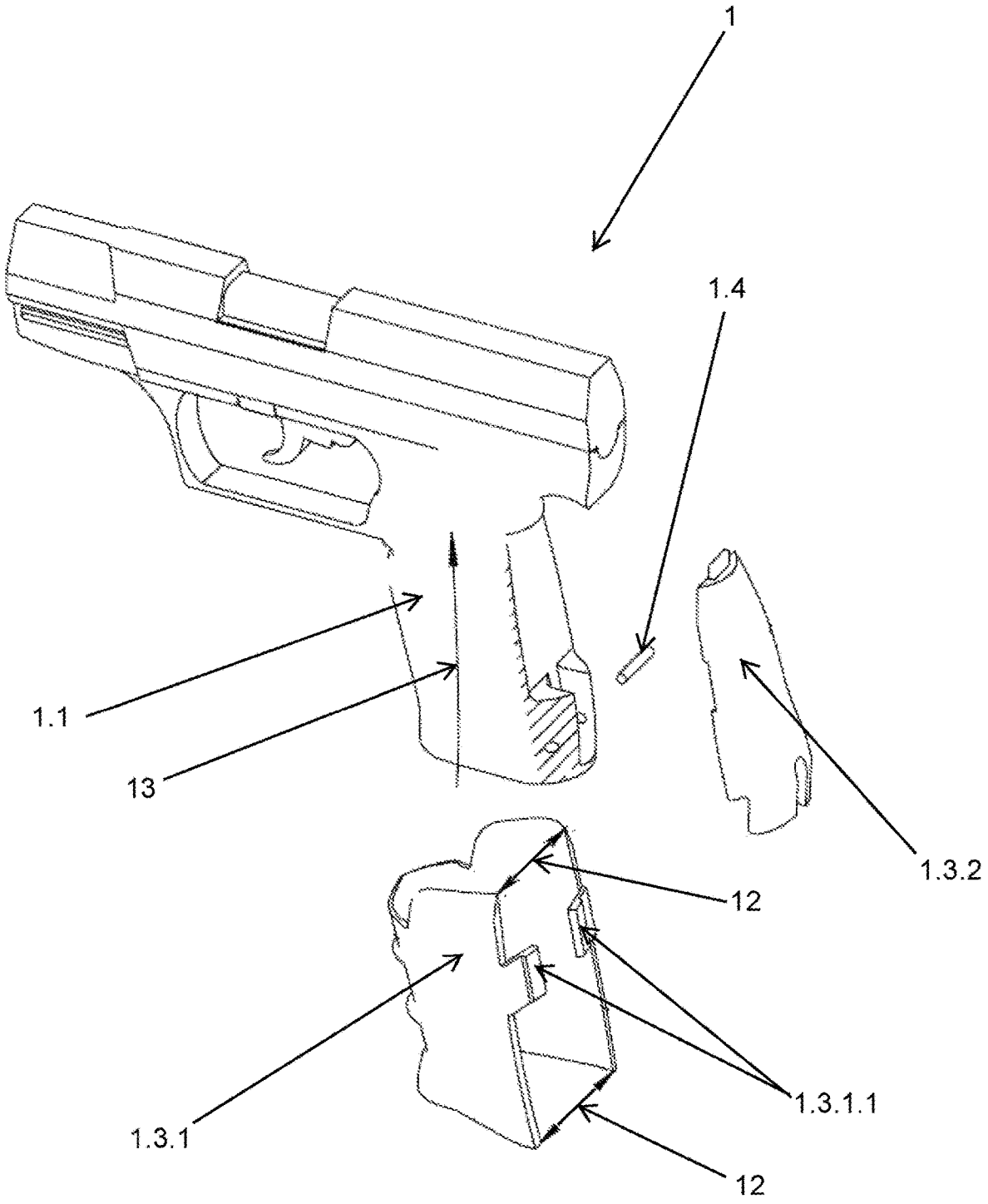
FIG. 5 is a perspective view of a firearm, the pin, and the present invention's components in disassembled configuration.
Figure 6:
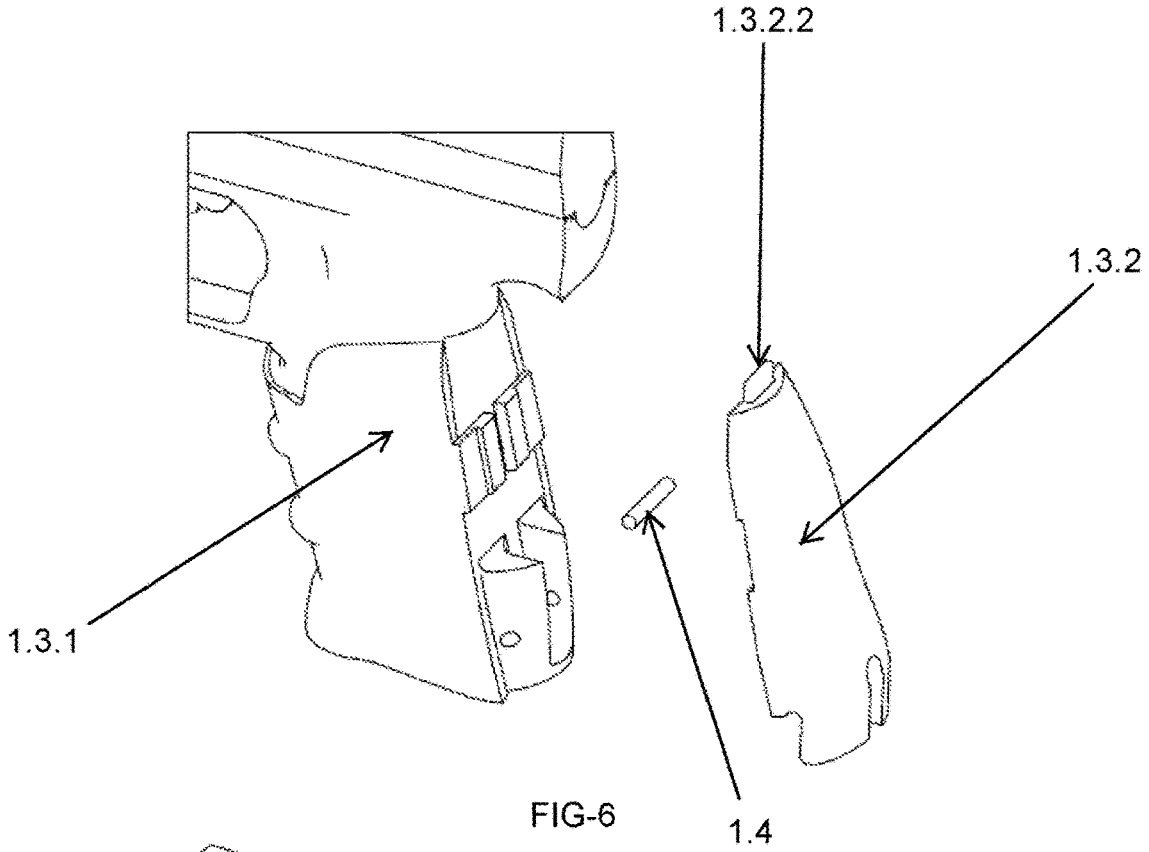
FIG. 6 is a perspective view of the grip sleeve in mounted configuration and the interlocking backstrap in its initial position for installation.

The grip sleeve (1.3.1) is made of relatively flexible, highly durable, and impact-resistant plastic material. The sleeve (1.3.1) is designed to conform closely to the shape of the handgrip (1.1). Once mounted on the grip (1.1), the sleeve (1.3.1) fits without slack, as depicted in FIG. 6. Subsequently, the sleeve protrusion (1.3.1.1) on the sleeve (1.3.1) is designed to engage the sleeve cavity (1.3.2.1) on the interlocking backstrap (1.3.2), as shown in FIG. 4.

To install the sleeve (1.3.1) onto the grip (1.1), the sleeve (1.3.1) is flexed outward in i-direction (12) for sleeve protrusion (1.3.1.1) to clear shaded area-2 (1.1.1) so that movement in z-direction (13) can be made without collision. The installation at this stage is depicted in FIG. 6.

Figure 7:
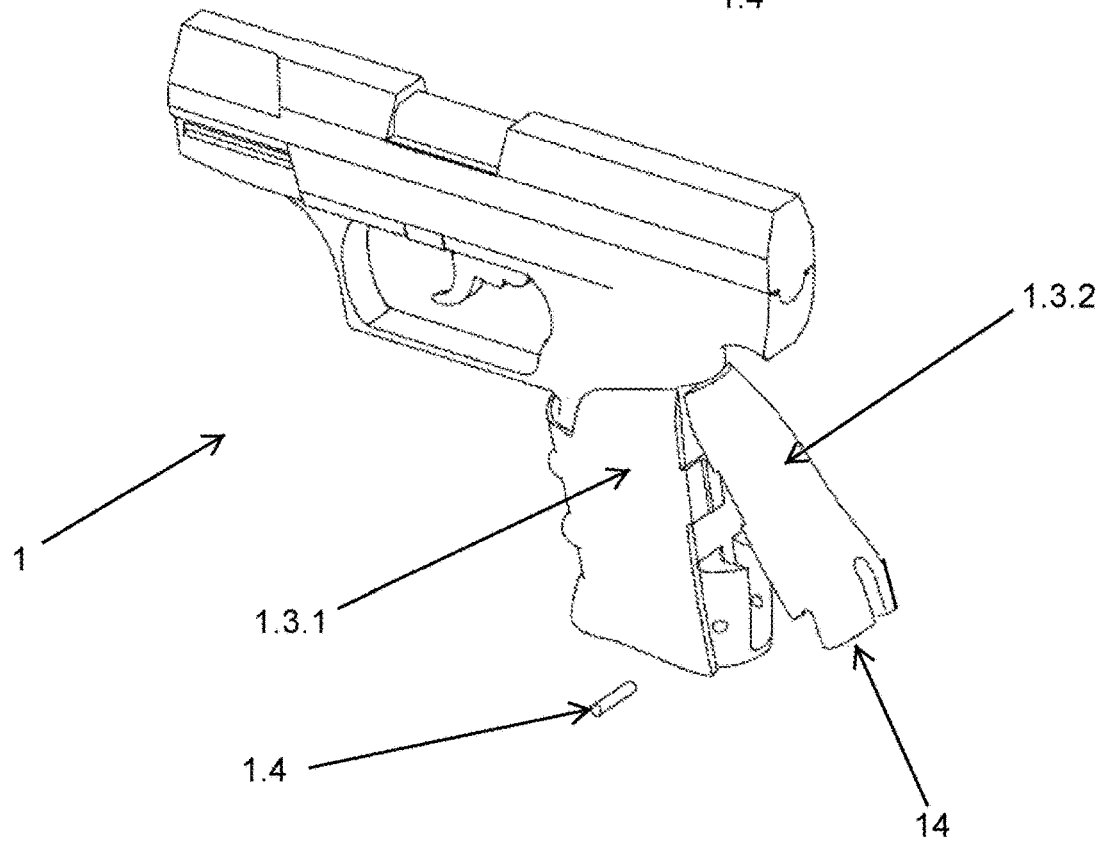
FIG. 7 is a perspective view of the grip sleeve in mounted configuration and the interlocking backstrap in its initial position for installation.
Figure 8:
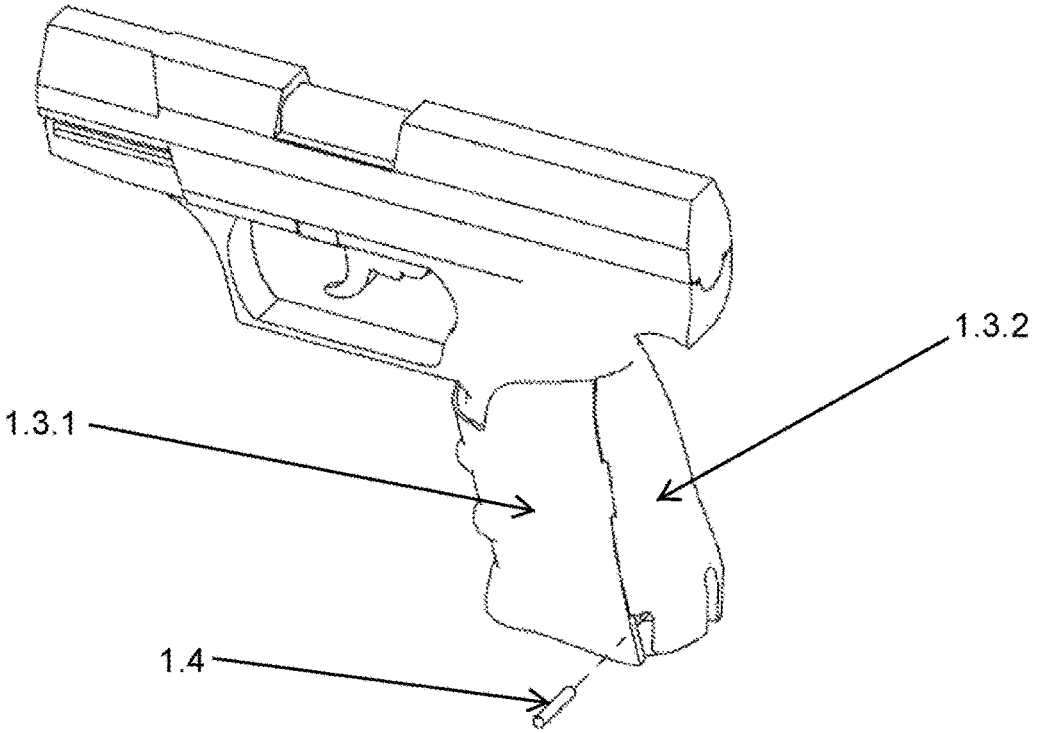
FIG. 8 is a perspective view of the grip assembly in mounted configuration with the locking pin in exploded configuration.
Figure 9:
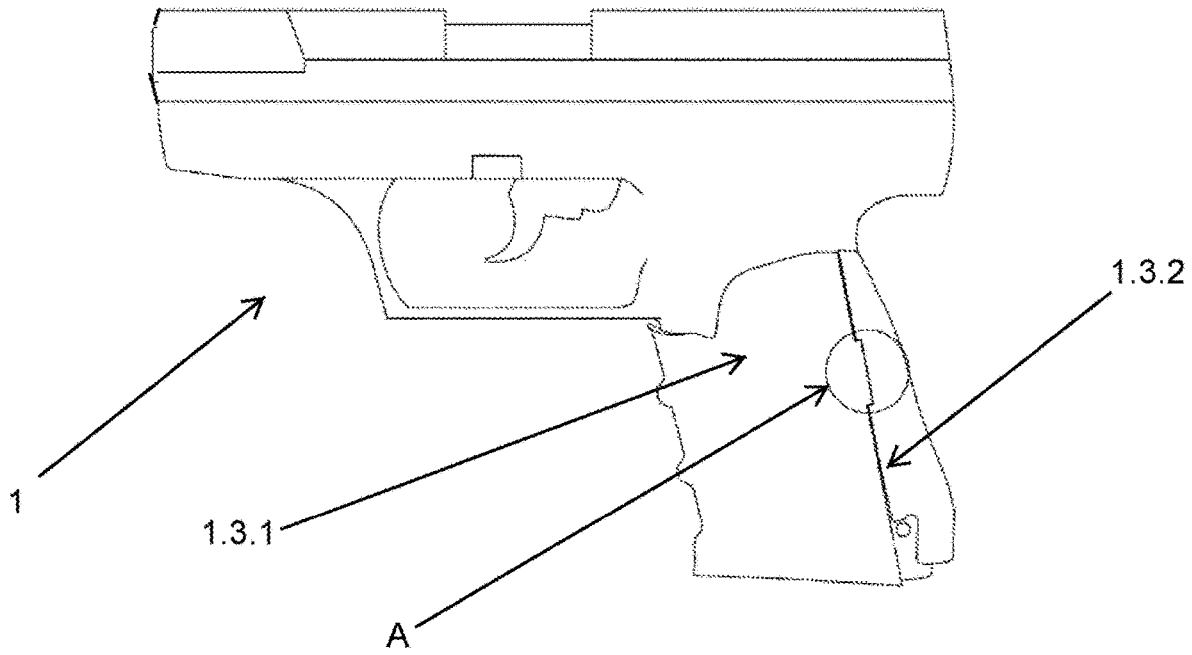
FIG. 9 is a side view of the grip assembly in mounted configuration.
Figure 10:
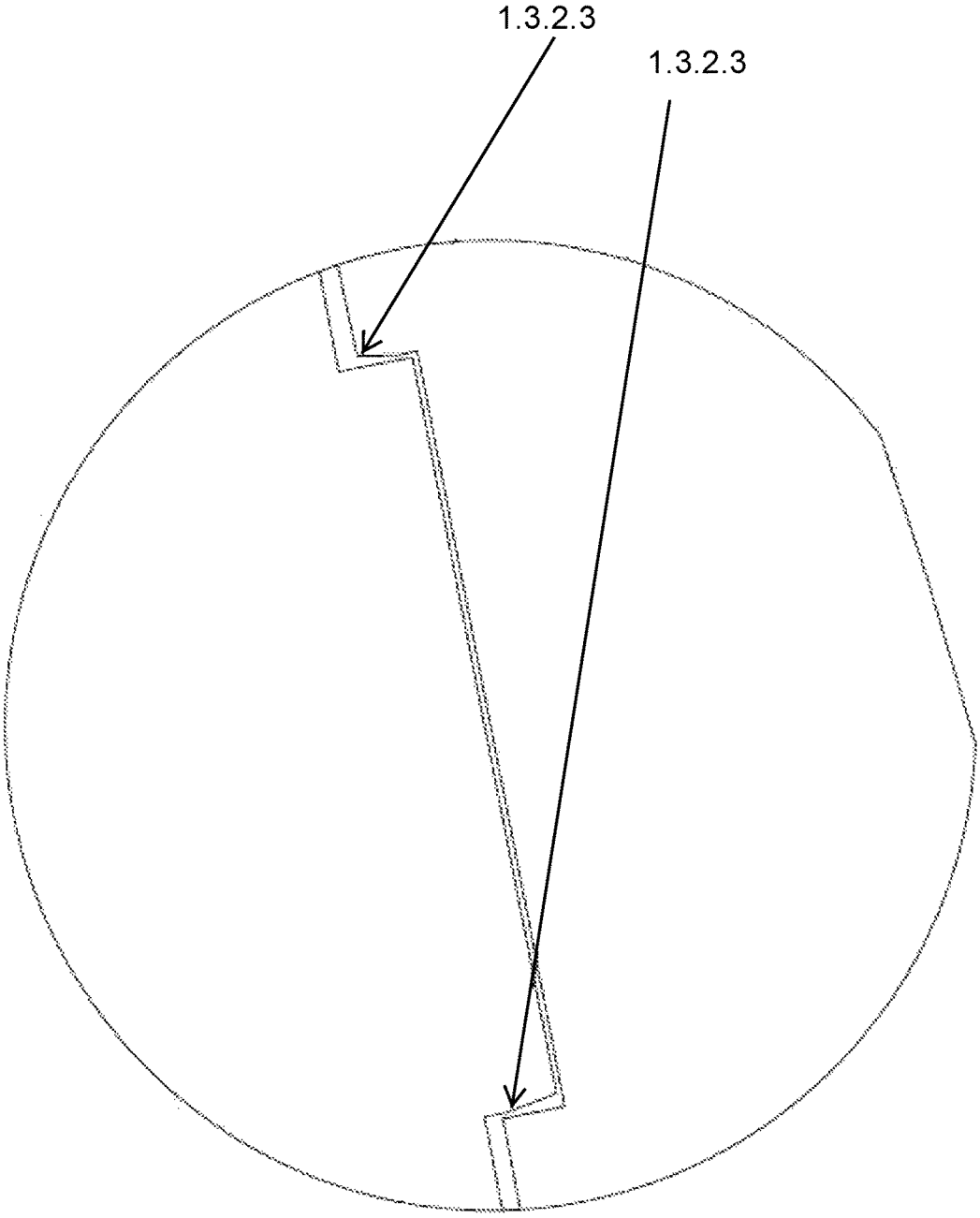
FIG. 10 is the enlarged side view "A"

To install the interlocking backstrap (1.3.2), the backstrap top protrusion (1.3.2.2) is arranged to be inside a cavity inside the handgrip (1.1) in the initial position for installation (14) as shown in FIG. 7. The interlocking backstrap (1.3.2) is then rotated around the backstrap top protrusion (1.3.2.2) and positioned as depicted in FIG. 8.

The chamfered regions (1.3.2.3) provide appropriate clearance without compromising on the tight fit necessary between the interlocking backstrap (1.3.2) and the sleeve (1.3.1) during the rotational movement commencing from the initial position for installation (14) towards the handgrip (1.1).

To secure the assembly onto the handgrip (1.1), the factory method of fastening is employed, which for the preferred embodiment, is the locking pin (1.4). Consequently, the handgrip (1.1) is enveloped on all sides, with the sleeve (1.3.1) covering the front and sides while the interlocking backstrap (1.3.2) covers the rear.

Thus, the present invention (1.3), enveloping the handgrip (1.1) of the firearm, facilitates form and texture modifications on all sides according to user preferences.

The invention is a handgrip assembly (1.3) comprising:

- a removably mounted grip sleeve (1.3.1) that, once mounted, envelops the front and sides of the handgrip (1.1) without gaps or play;

and

- an interlocking backstrap (1.3.2) having a sleeve cavity (1.3.2.1) adapted to engage a sleeve protrusion (1.3.1.1) to clamp the sleeve (1.3.1) tightly onto the handgrip (1.1), whereon the said backstrap is secured via a locking pin (1.4) on the handgrip (1.1).

In another embodiment of the invention is a handgrip assembly (1.3), comprising:

- a grip sleeve (1.3.1) removably mounted that once mounted envelops the front and the sides of the handgrip (1.1) without gaps or play;
  - whereon a magwell (1.3.1.2) being an oblong funnel-shaped geometric feature sitting flush to the entrance of the magazine cavity of a firearm (1), extending and widening outwardly therefrom to assist a user in guiding the magazine body into the magazine cavity;

and

Figure 11:
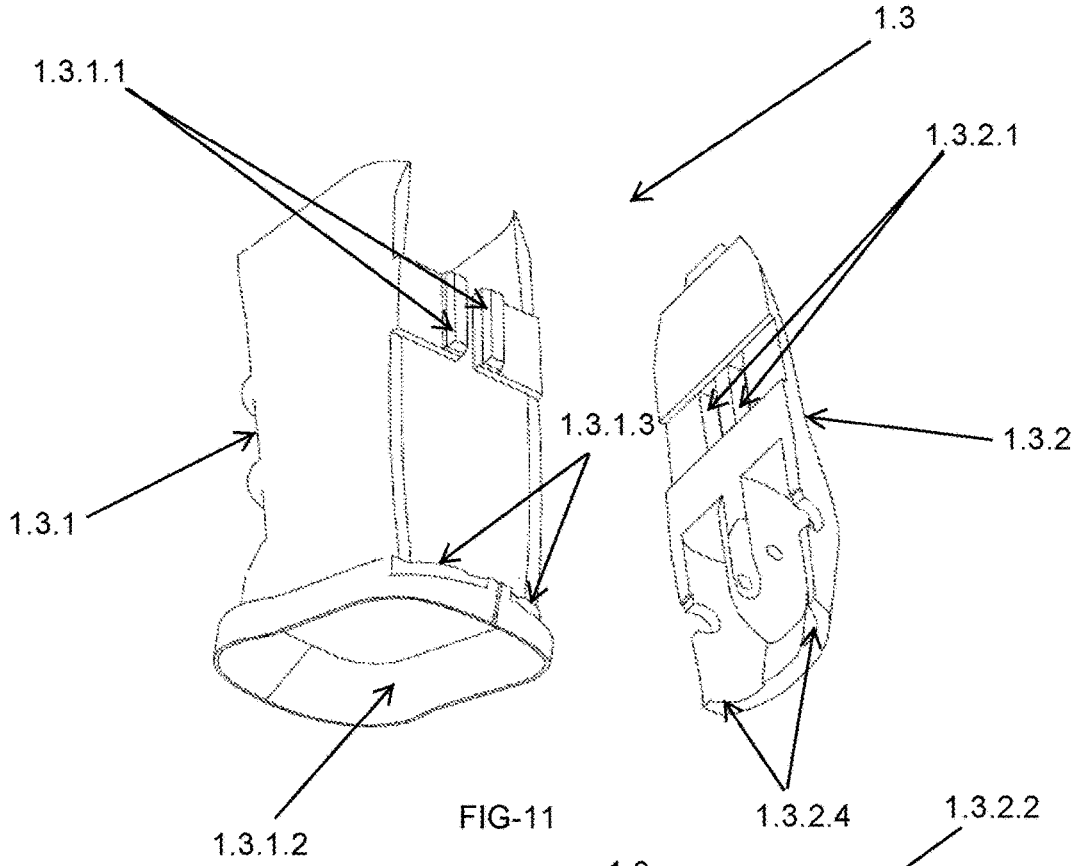
FIG. 11 is a bottom perspective view of an embodiment of the present invention where a grip sleeve incorporating the magwell option and corresponding interlocking backstrap are in disassembled configuration.
Figure 12:
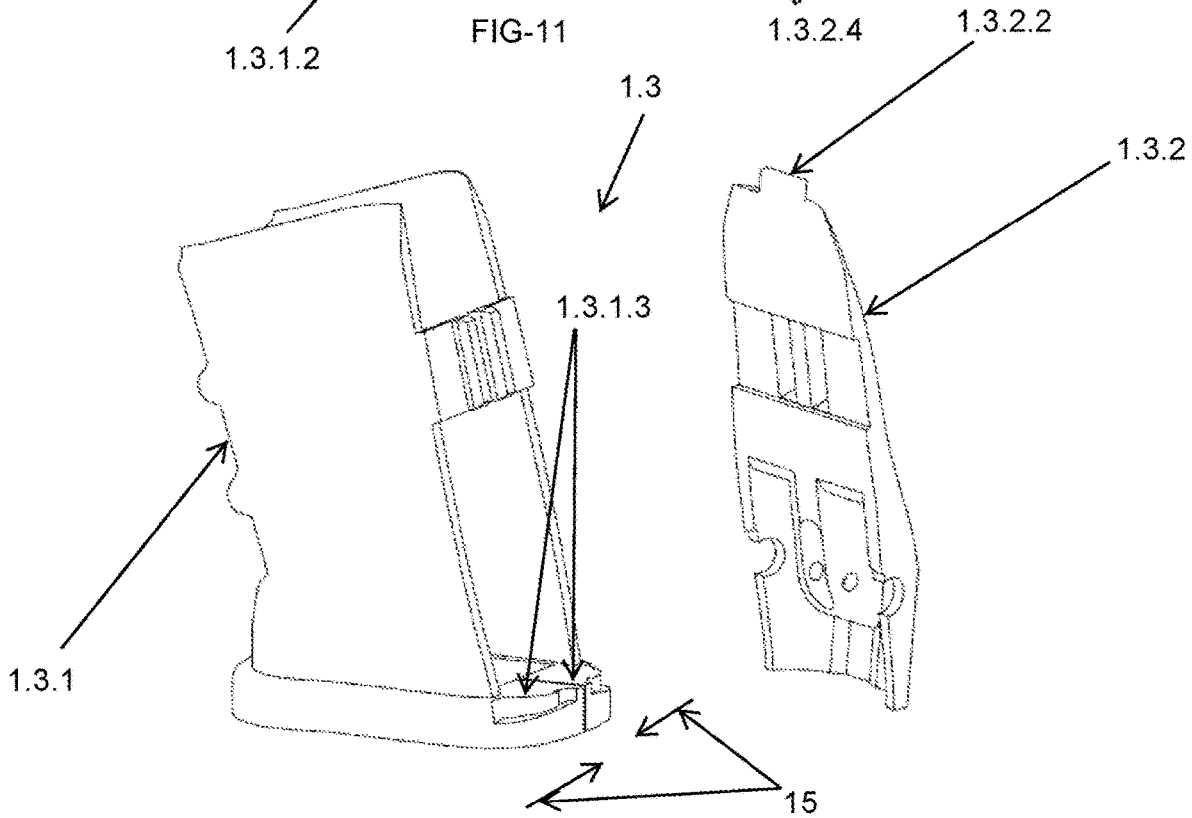
FIG. 12 is a side perspective view of an embodiment of the present invention with a grip sleeve incorporating the magwell option, and corresponding interlocking backstrap in disassembled configuration.
Figure 13:
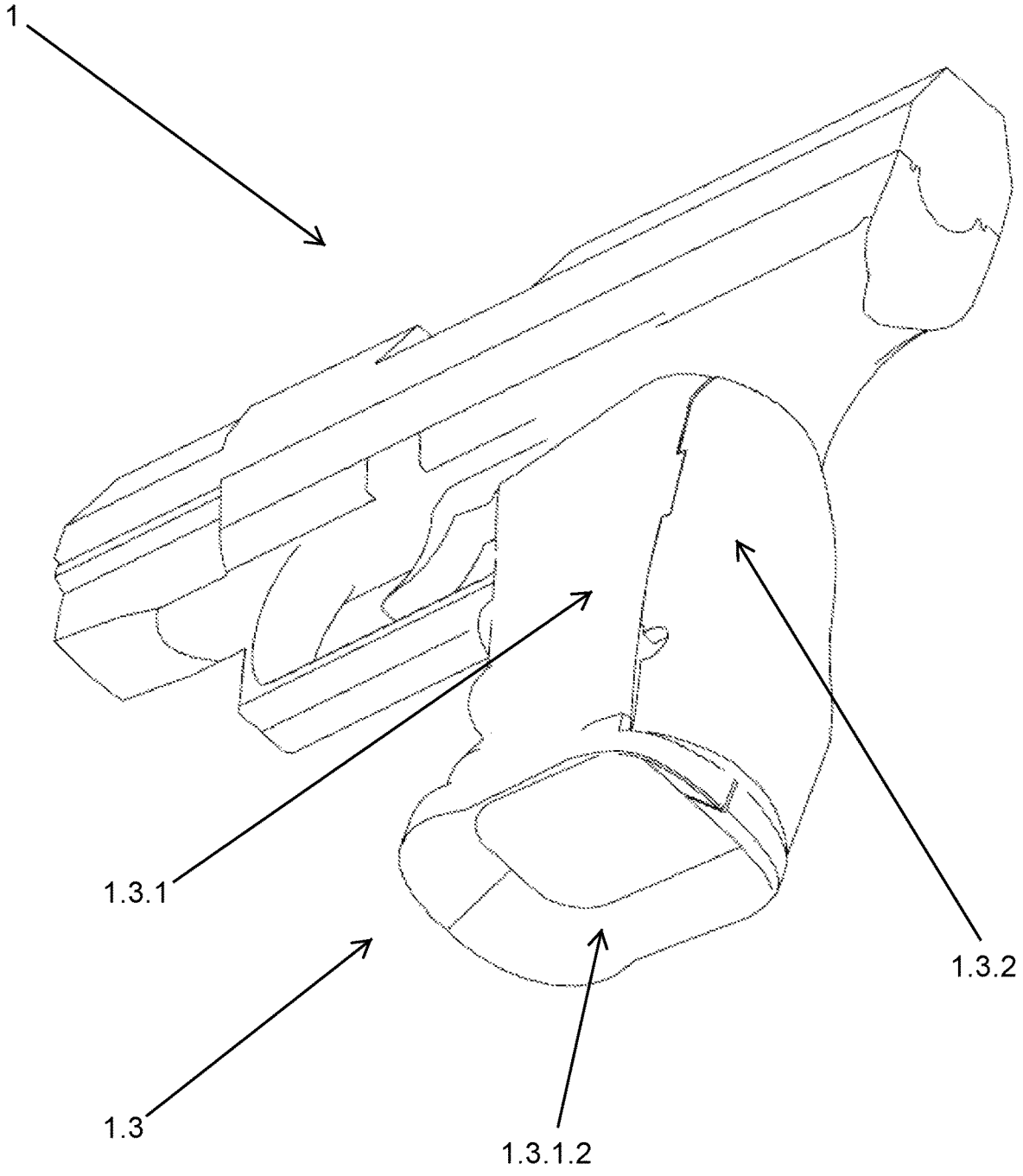
FIG. 13 is a bottom perspective view of an embodiment of the present invention on a firearm with the grip sleeve incorporating magwell option and the corresponding interlocking backstrap in mounted configuration.

- an interlocking backstrap (1.3.2) placed on the handgrip (1.1) from the said handgrip's (1.1) side closer to a user's body during normal operation, said interlocking backstrap having a sleeve cavity (1.3.2.1) adapted to engage a sleeve protrusion (1.3.1.1) on the sleeve (1.3.1); a magwell cavity (1.3.2.4) adapted to engage a magwell protrusion (1.3.1.3) whose sloping geometry tightly clamps, in the w-direction (15), the grip sleeve (1.3.1) onto the handgrip (1.1) whereon the said interlocking backstrap is secured via a locking pin (1.4) as depicted in FIG. 11, FIG. 12, and FIG. 13.

What is claimed is:

1. A retrofit handgrip assembly (1.3) for a firearm (1) having an existing handgrip (1.1) and an existing locking pin (1.4), the retrofit handgrip assembly comprising: a unitary grip sleeve (1.3.1) configured to, once mounted, fully envelops the front and the sides of the existing handgrip (1.1) without gaps or play; and an interlocking backstrap (1.3.2) having a sleeve cavity (1.3.2.1) with a plurality of recess regions adapted to engage a plurality of sleeve protrusions (1.3.1.1) extending from a rear region of the unitary grip sleeve (1.3.1) to clamp the unitary grip sleeve (1.3.1) tightly onto the existing handgrip (1.1) in a w-direction (15), whereon the said interlocking backstrap is further secured via the existing locking pin (1.4).

2. The retrofit handgrip assembly (1.3) of claim 1, wherein the unitary grip sleeve (1.3.1) having a portion extending inward with a cuboid protrusion therein, said portion being configured to flex outward in an i-direction (12) to clear a protruding part of the existing handgrip (1.1.1) to allow movement in a z-direction (13).

3. The retrofit handgrip assembly (1.3) of claim 1, wherein a backstrap top protrusion (1.3.2.2) is arranged to be inside a cavity inside the existing handgrip (1.1) in an initial position for installation (14).

4. The retrofit handgrip assembly (1.3) of claim 1, wherein the interlocking backstrap (1.3.2) with a backstrap top protrusion (1.3.2.2) disposed in a cavity on the existing handgrip (1.1), about which the interlocking backstrap (1.3.2) rotates.

5. The retrofit handgrip assembly (1.3) of claim 1, wherein the interlocking backstrap (1.3.2) is arranged to be inside a cavity inside the existing handgrip (1.1) in the initial position for installation (14) from which the interlocking backstrap's (1.3.2) angular approach is facilitated via chamfered regions (1.3.2.3).

6. The retrofit handgrip assembly (1.3) of claim 1, wherein the existing handgrip (1.1) is enveloped by the unitary grip sleeve (1.3.1) with outward-facing front and side surfaces configured to accept texture and form adaptations according to user preferences.

7. A retrofit handgrip assembly (1.3) for a firearm (1) having an existing handgrip and an existing locking pin, a magazine cavity, and a magazine body, the assembly comprising:

A unitary grip sleeve (1.3.1) that, once mounted, fully envelops the front and sides of the existing handgrip (1.1) without gaps or play;

whereon a magwell (1.3.1.2) comprises an oblong funnel-shaped geometric feature sitting flush to an entrance of the magazine cavity of the firearm (1), extending and widening outwardly therefrom to assist a user in guiding the magazine body into the magazine cavity; and an interlocking backstrap (1.3.2) placed on the existing handgrip (1.1) from the said existing handgrip's (1.1) side closer to a user's body during normal operation, said interlocking backstrap having a plurality of sleeve cavity (1.3.2.1) adapted to engage a plurality of sleeve protrusions (1.3.1.1) on the unitary grip sleeve (1.3.1); a magwell cavity (1.3.2.4) adapted to engage a magwell protrusion (1.3.1.3) whose sloping geometry tightly clamps, in a w-direction (15), the unitary grip sleeve (1.3.1) onto the existing handgrip (1.1), whereon the said interlocking backstrap (1.3.2) is further secured via the existing locking pin (1.4).

* * * * *